US010907427B2

(12) United States Patent
Bellicard et al.

(10) Patent No.: US 10,907,427 B2
(45) Date of Patent: Feb. 2, 2021

(54) SYSTEMS AND METHODS FOR OPERATING A DOWNHOLE BATTERY

(71) Applicant: Schlumberger Technology Corporation, Sugar Land, TX (US)

(72) Inventors: Claire Bellicard, Houston, TX (US); Stephanie Elstrop, Houston, TX (US); Caroline Stephan Rivas, Houston, TX (US); Todor Sheiretov, Houston, TX (US); Adebayo Taiwo, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 101 days.

(21) Appl. No.: 15/830,084

(22) Filed: Dec. 4, 2017

(65) Prior Publication Data

US 2019/0169946 A1 Jun. 6, 2019

(51) Int. Cl.

| | |
|---|---|
| ***E21B 23/00*** | (2006.01) |
| ***E21B 41/00*** | (2006.01) |
| ***E21B 47/00*** | (2012.01) |
| ***E21B 47/07*** | (2012.01) |
| *E21B 49/00* | (2006.01) |

(52) U.S. Cl.

CPC ..... *E21B 23/00* (2013.01); *E21B 41/0085* (2013.01); *E21B 47/07* (2020.05); *E21B 49/00* (2013.01)

(58) Field of Classification Search

CPC ..... E21B 23/00; E21B 47/065; E21B 49/00; E21B 41/0085; E21B 41/00; E21B 47/07

See application file for complete search history.

(56) References Cited

U.S. PATENT DOCUMENTS

| | | | | |
|---|---|---|---|---|
| 5,784,004 | A * | 7/1998 | Esfahani | E21B 47/06 166/250.01 |
| 2006/0191687 | A1 | 8/2006 | Storm et al. | |
| 2015/0129204 | A1* | 5/2015 | Smith | E21B 17/06 166/250.01 |
| 2015/0361788 | A1* | 12/2015 | Liu | H02J 7/00 340/855.4 |
| 2016/0116889 | A1 | 4/2016 | Zacharko et al. | |
| 2016/0145974 | A1* | 5/2016 | Tahoun | E21B 41/00 175/50 |
| 2016/0241053 | A1 | 8/2016 | Erdos et al. | |
| 2016/0299253 | A1 | 10/2016 | Zhang et al. | |

(Continued)

OTHER PUBLICATIONS

Exium Tech. Inc. MWD Lithium Battery Brochure (Year: 2014).*

(Continued)

*Primary Examiner* — George S Gray

(74) *Attorney, Agent, or Firm* — Eileen Pape

(57) ABSTRACT

A method includes receiving, via a battery controller of a battery system, a timer value. The method also includes enabling, via the battery controller, the battery system to provide power to a release device in a wellbore upon receiving the timer value. Moreover, the method includes receiving, via the battery controller, an updated timer value, and the updated timer value changes the timer value, and the battery system continues to provide power to the release device at least until the updated timer value expires.

18 Claims, 3 Drawing Sheets

(56) References Cited

U.S. PATENT DOCUMENTS

2017/0030159 A1* 2/2017 Vick, Jr. ..... E21B 23/00

OTHER PUBLICATIONS

International Search Report and Written Opinion issued in the corresponding PCT Application PCT/US2018/063711, dated Mar. 20, 2019 (14 pages).
International Preliminary Report on Patentability issued in the PCT Application PCT/US2018/063711, dated Jun. 18, 2020 (11 pages).

* cited by examiner

SYSTEMS AND METHODS FOR OPERATING A DOWNHOLE BATTERY

BACKGROUND

This disclosure relates to systems and methods to provide a downhole battery in a wellbore, which may enable other downhole devices to continue receiving power.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, these statements are to be read in this light, and not as admissions of any kind.

To locate and extract resources from a well, a wellbore may be drilled into a geological formation. Downhole devices, such as toolstrings and sensors, may be placed into the wellbore to obtain measurements relating to the wellbore. These downhole devices may receive power from the surface via an electrified cable and/or from batteries connected to the downhole device in the wellbore. During certain operations, downhole devices may be cut off from power sources on the surface. As such, batteries within the wellbore may be utilized to provide power to the downhole devices. Therefore, improving the lifespan and operability of batteries within the wellbore may be beneficial.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one example, a method includes receiving, via a battery controller of a battery system, a timer value. The method also includes enabling, via the battery controller, the battery system to provide power to a release device in a wellbore upon receiving the timer value. Moreover, the method includes receiving, via the battery controller, an updated timer value, and the updated timer value changes the timer value, and the battery system continues to provide power to the release device at least until the updated timer value expires.

In another example, a method includes receiving, via a battery controller of a battery system, a threshold temperature value. The method also includes receiving, via the battery controller, temperature data from one or more sensors. Moreover, the method includes enabling, via the battery controller, the battery system to provide power to a release device in a wellbore upon the temperature data exceeding the threshold temperature value.

In yet another example, a system includes a battery system that includes a battery controller configured to receive a timer value. The battery controller is also configured to enable the battery system to provide power to a release device in a wellbore upon receiving the timer value. Moreover, the battery controller is configured to receive an updated timer value, and the updated timer value changes the timer value, and the battery system continues to provide power to the release device at least until the updated timer value expires.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
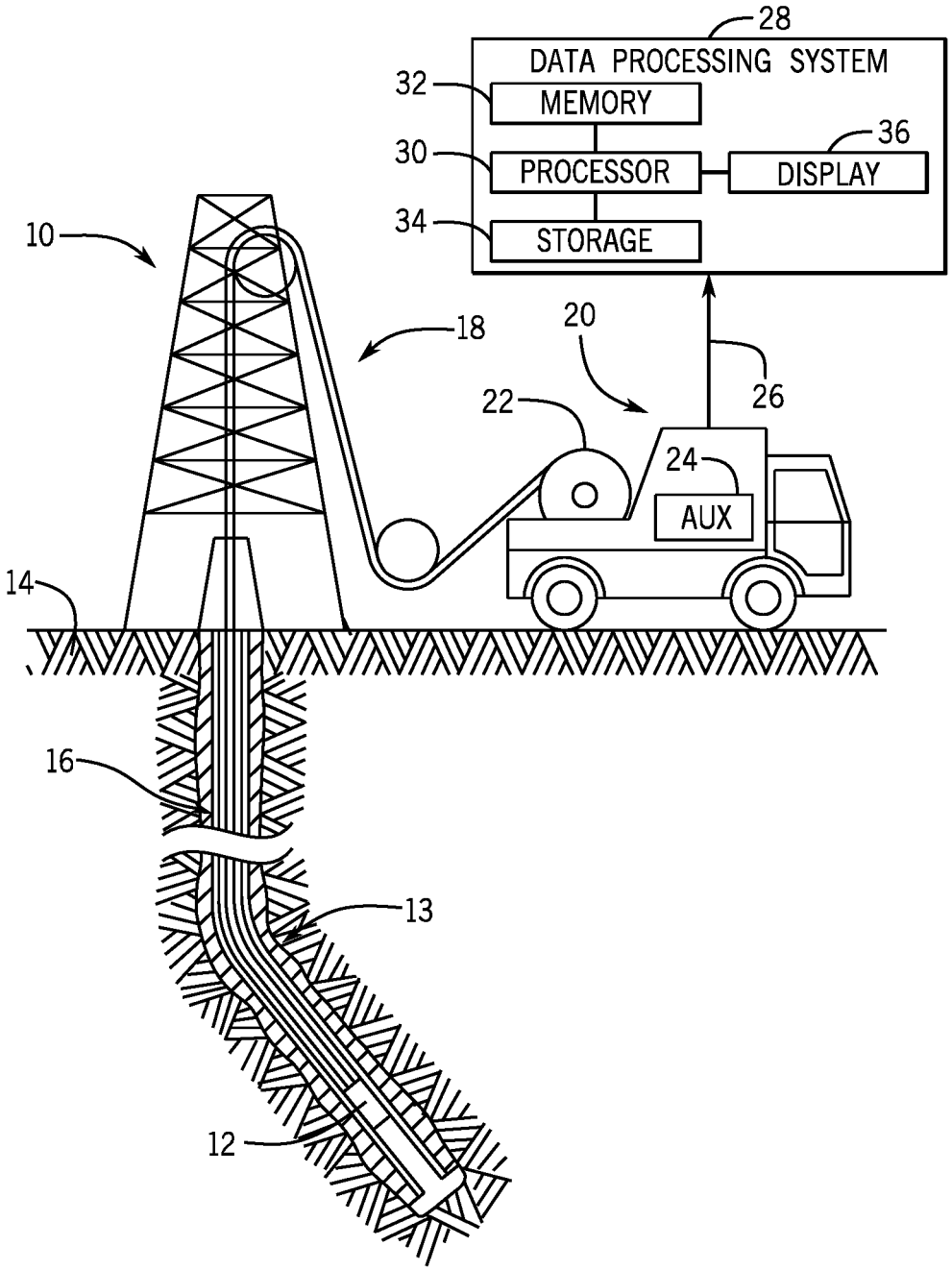
FIG. 1 is a schematic diagram of a wireline system that includes a toolstring to detect properties of a wellbore or geological formation adjacent to the toolstring, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The present disclosure relates to devices that improve the lifespan and operability of batteries within a wellbore to provide power to downhole devices when power sources on the surface are unable to provide power to the downhole devices. Toolstrings containing downhole tools may be placed into the wellbore to gather information about the geological formation. During certain operations, the downhole devices may be cut off from power sources on the surface. Utilizing downhole batteries may provide power to the downhole devices to enable the downhole devices to return to the surface, or to an area where power from the surface may be restored. Further, some wellbores may have ambient conditions, such as temperature and pressure, that are relatively extreme. Indeed, in some cases the temperature may exceed 150° C., and may even exceed 175° C. or 200° C. Specialized batteries have been developed that can operate under these conditions. However, many of the batteries designed for operation in such relatively high temperatures may suffer damage or shortened lifespan if they are operated at lower temperatures.

Accordingly, embodiments of this disclosure relate to a system and method for operating a downhole battery in a way that protects the battery from damage and/or extends the operational lifetime of the battery. Some embodiments include a control system to control a battery so that it operates under certain conditions for which it is well suited, but not in others where it could suffer damage. Indeed, a downhole battery specifically designed for downhole environments may be more effectively and/or efficiently operated in downhole conditions rather than surface conditions. Thus, the control system of this disclosure may control the battery to remain inoperative until ambient conditions around the battery reach a threshold.

For example, a downhole device may have a battery designed for operation in temperatures greater than some threshold (e.g., greater than 125° C., greater 150° C., greater than 175° C., greater than 200° C., or the like). When the downhole device is placed into a wellbore having a correspondingly high temperature, it may take some time before the battery reaches the ambient conditions of the wellbore. Thus, if the downhole device were to operate the battery too soon after being placed into the wellbore, the battery would operate at a lower temperature than it is designed to operate. Since operating at this lower temperature could damage the battery and/or shorten the lifespan of the battery, the systems and methods of this disclosure may prevent the battery from operating until the ambient conditions around the battery are satisfactory.

With this in mind, FIG. 1 illustrates a well-logging system 10 that may employ the systems and methods of this disclosure. The well-logging system 10 may be used to convey a toolstring 12 through a geological formation 14 via a wellbore 16. Further, the wellbore 16 may not continue straight down into the geological formation 14, and the wellbore 16 may contain a turn 13. The wellbore 16 may continue past the turn into the geological formation 14 at an angle as high as ninety degrees. In the example of FIG. 1, the toolstring 12 is conveyed on a cable 18 via a logging winch system (e.g., vehicle) 20. Although the logging winch system 20 is schematically shown in FIG. 1 as a mobile logging winch system carried by a truck, the logging winch system 20 may be substantially fixed (e.g., a long-term installation that is substantially permanent or modular). Any suitable cable 18 for well logging may be used. The cable 18 may be spooled and unspooled on a drum 22 and an auxiliary power source 24 may provide energy to the logging winch system 20, the cable 18, and/or the toolstring 12.

Moreover, while the toolstring 12 is described as a wireline toolstring, it should be appreciated that any suitable conveyance may be used. For example, the toolstring 12 may instead be conveyed on a slickline or via coiled tubing, or as a logging-while-drilling (LWD) tool as part of a bottom hole assembly (BHA) of a drill string, and so forth. For the purposes of this disclosure, the toolstring 12 may include any suitable tool that utilizes electricity, such as a sensor to obtain measurements of properties of the geological formation 14, a drilling tool, a material collection tool, tractor tool, etc. The toolstring 12 may include multiple downhole tools, such as 2, 3, 4, 5, 6, or more downhole tools to conduct operation in the wellbore 16.

The toolstring 12 may emit energy into the geological formation 14, which may enable measurements to be obtained by the toolstring 12 as data 26 relating to the wellbore 16 and/or the geological formation 14. The data 26 may be sent to a data processing system 28. For example, the data processing system 28 may include a processor 30, which may execute instructions stored in memory 32 and/or storage 34. As such, the memory 32 and/or the storage 34 of the data processing system 28 may be any suitable article of manufacture that can store the instructions. The memory 32 and/or the storage 34 may be read-only memory (ROM), random-access memory (RAM), flash memory, an optical storage medium, or a hard disk drive, to name a few examples. A display 36, which may be any suitable electronic display, may display the images generated by the processor 30. The data processing system 28 may be a local component of the logging winch system 20 (e.g., within the toolstring 12), a remote device that analyzes data from other logging winch systems 20, a device located proximate to the drilling operation, or any combination thereof. In some embodiments, the data processing system 28 may be a mobile computing device (e.g., tablet, smart phone, or laptop) or a server remote from the logging winch system 20.

Figure 2:
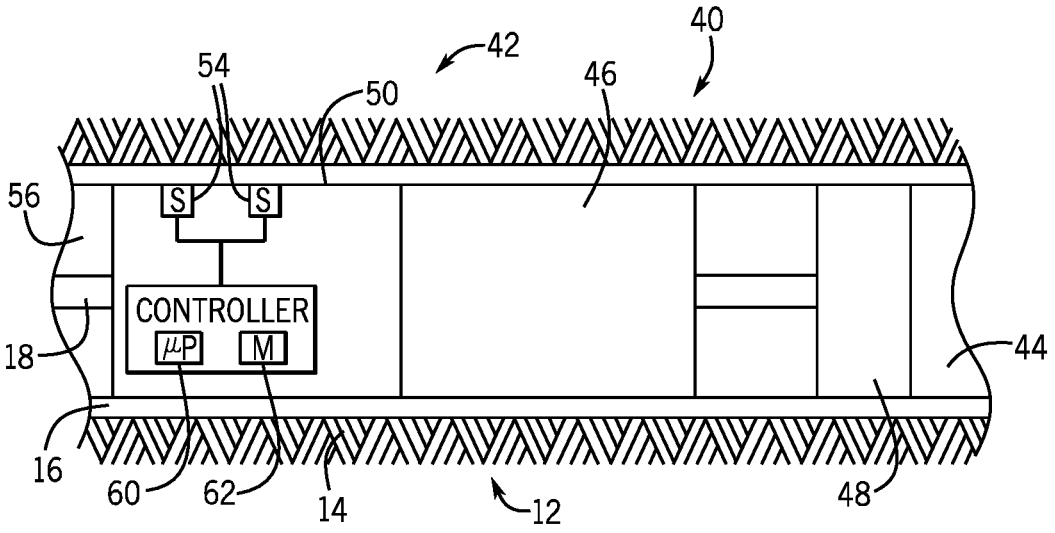
FIG. 2 is a schematic diagram of the toolstring of FIG. 1 that includes a battery system and a release device system coupled to a downhole tool.

FIG. 2 illustrates an embodiment of the toolstring 12 that includes a release device system 40, a battery system 42, and a downhole tool 44. The toolstring 12 may descend into the wellbore 16 to perform various operations (e.g., data gathering, sample collection, drilling, etc.) via the downhole tool 44. The cable 18 may be utilized to provide power to the release device system 40 and the downhole tool 44. During certain operations, the downhole tool 44 may become stuck within the wellbore 16. When the downhole tool 44 becomes stuck, the fastest way to continue may be to utilize the release device system 40 to release the downhole tool 44 from the toolstring 12, and retrieve the downhole tool 44 with other equipment. Accordingly, the release device system 40 includes a motor 46 to drive a release device 48. However, when the downhole tool 44 becomes stuck, power supplied through the cable 18 is often cut off. As such, the battery system 42 is utilized to supply power to the release device system 40 to enable the release device system 40 to release the downhole tool 44 when power through the cable 18 is lost.

The battery system 42 includes a battery 50, a battery controller 52, and sensors 54. The battery 50 can only hold a limited amount of power, and leaving the battery on drains the power of the battery 50. As such, the battery controller 52 is included to enable and disable the battery 50, which increases the amount of time the battery 50 may be utilized. For example, an operator, the battery controller 52, or both may be able to recognize certain times during which the battery 50 is more likely to be utilized, and direct the battery 50 to be enabled during such times.

Further, the conditions within an interior 56 of the wellbore 16 may be vastly different from conditions at the surface. For example, the temperature in the interior 56 of the wellbore 16 may be 140 degrees C. (C) to 190 degrees C., 150 degrees C. to 180 degrees C., 165 degrees C. to 178 degrees C., 170 degrees C. to 175 degrees C., or other similar temperatures. As such, the battery 50 may be adapted to operate at these temperatures within the interior 56 of the wellbore 16. However, batteries adapted to operate at such temperatures may be inefficient or unable to provide sufficient power in lower-temperature conditions (e.g., 20 degrees C. to 40 degrees C., or beneath some other particular threshold temperature value), or may be damaged and/or suffer a shortened lifespan operating under the lower-temperature conditions.

Accordingly, the battery controller 52 may enable or disable the battery 50 in response to certain conditions. The sensors 54 are included to sense the environment (e.g., temperature, pressure, telemetry, etc. of the interior 56 of the wellbore 16) in which the battery 50 operates. For example, the battery 50 may operate in the higher temperature ranges present in the interior 56 of the wellbore 16. The battery controller 52 may receive temperature data from the sensors 54 and operate the batter 50 based on the temperature data from the sensors 54. For example, the battery controller 52 may disable the battery 50 at temperatures below a threshold temperature, and enable the battery 50 at temperatures above a threshold temperature. In some embodiments, more or fewer sensors 54 may be included, such as 1, 3, 4, 5, 6, or more sensors 54. While the battery 50 may operate at the higher temperatures present in the interior 56, there may be sections in the interior 56 of the wellbore 16 that are at an even higher temperature, which may be at a temperature too high for safe operation of the battery 50. Accordingly, the battery controller 52 may also disable the battery 50 if the temperature is higher than a threshold temperature.

Further, the battery controller 52 may be utilized to control the release device system 40. For example, when power through the cable 18 is cut off, communications are also often cut off. As such, the battery controller 52 may be utilized to operate the release device system 40 even in the absence of communication from the surface.

In the illustrated embodiment, the battery controller 52 includes a processor, such as the illustrated microprocessor 60, and a memory device 62. The battery controller 52 may also include one or more storage devices and/or other suitable components. The microprocessor 60 may be used to execute software, such as software for controlling the battery 50, and so forth. Moreover, the microprocessor 60 may include multiple microprocessors, one or more "general-purpose" microprocessors, one or more special-purpose microprocessors, and/or one or more application specific integrated circuits (ASICS), or some combination thereof. For example, the microprocessor 60 may include one or more reduced instruction set (RISC) processors.

The memory device 62 may include a volatile memory, such as random access memory (RAM), and/or a nonvolatile memory, such as read-only memory (ROM). The memory device 62 may store a variety of information and may be used for various purposes. For example, the memory device 62 may store processor-executable instructions (e.g., firmware or software) for the microprocessor 60 to execute, such as instructions for controlling the battery 50. The storage device(s) (e.g., nonvolatile storage) may include ROM, flash memory, a hard drive, or any other suitable optical, magnetic, or solid-state storage medium, or a combination thereof. The storage device(s) may store data, instructions (e.g., software or firmware for controlling the battery 50, etc.), and any other suitable data. Further, the battery controller 52 may be located in any suitable location, such as along the toolstring 12, within or external to the battery 50, at the surface, etc. Further, the battery controller 52 may be part of the data processing system of FIG. 1.

Figure 3:
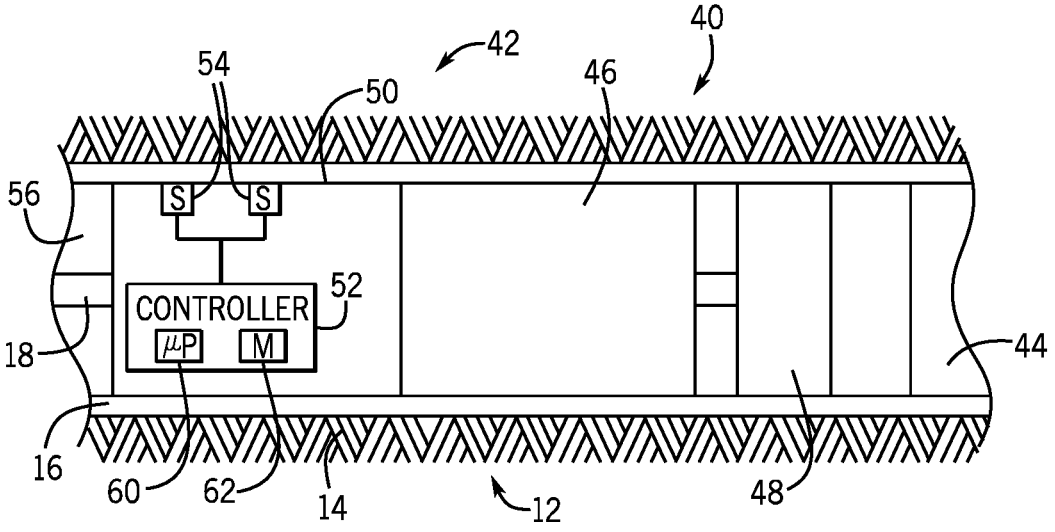
FIG. 3 is a schematic diagram of the toolstring of FIG. 1 that includes a battery system and a release device system decoupled to a downhole tool.

FIG. 3 illustrates an embodiment of the release device system 40 after releasing from the downhole tool 44. As discussed above, the downhole tool 44 may become stuck during certain operations, and may be released from the toolstring 12. Accordingly, the motor 46 has caused the release device 48 to retract from the downhole tool 44, thereby mechanically decoupling the release device 48 and the downhole tool 44. After the downhole tool 44 has been released, the remaining toolstring 12 may return to the surface to enable other devices to retrieve the stuck downhole tool 44. In the present embodiment, the battery system 42 is utilized to provide power to the release device system 40 in case the power from the cable 18 is cut off, which often happens when a downhole tool 44 becomes stuck. In the present embodiment, the battery system 42 is illustrated operating the release device system 40. It should be appreciated that the battery system 42 may be utilized to provide power to any downhole system, such as a tractor device, a downhole tool, or any other downhole device that utilizes power.

Figure 4:
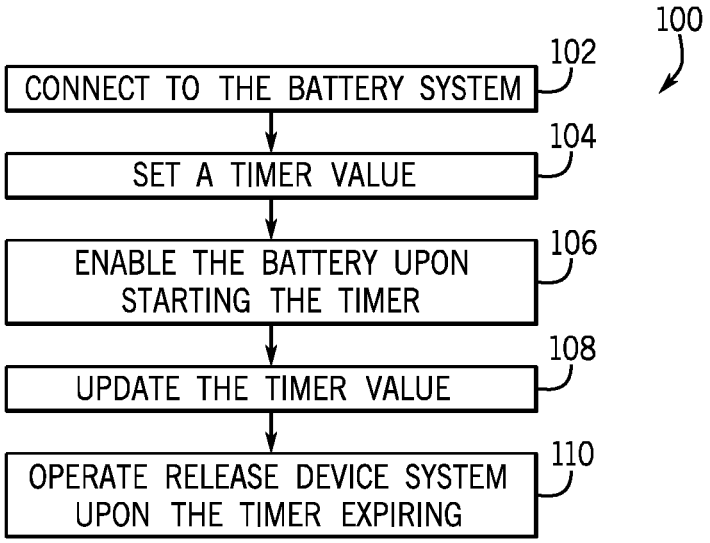
FIG. 4 is an embodiment of a process for operating the battery system of FIG. 2.

FIG. 4 is a flowchart of an embodiment of a process 100 for controlling the battery system to preserve the charge of the battery. The process 100 enables the battery system to operate even if connection to the surface is lost. Although the following process 100 includes a number of operations that may be performed, it should be noted that the process 100 may be performed in a variety of suitable orders (e.g., the order that the operations are discussed, or any other suitable order). All of the operations of the process 100 may not be performed. Further, all of the operations of the process 100 may be performed by the battery controller, the data processing system, an operator, or a combination thereof.

First, an operator may connect (block 102) to the battery system. For example, while the battery system is in the wellbore, the battery system may be in communication with the surface (e.g., via the cable). An operator may interact with the battery system via a user interface through which the operator may enter commands, view battery conditions (e.g., remaining charge, ambient temperature, etc.), etc.

The operator may set (block 104) a timer value. The timer value may be based on how long a particular operation will last, how long a toolstring may be without surface power before returning to the surface, etc. While setting the timer value, an operator may enter a timer value into the user interface, and interact with prompts to confirm the timer value is correct before setting the timer value. In some cases, the timer may be set to an amount of time that would be expected to allow the ambient conditions of the wellbore 16 to raise the temperature of the battery system to some threshold temperature. This threshold temperature may be any suitable temperature that allows the battery system to operate sufficiently efficiently and/or effectively where damage to the battery system would be reduced and/or eliminated (e.g., 140 degrees C. to 190 degrees C., 150 degrees C. to 180 degrees C., 165 degrees C. to 178 degrees C., 170 degrees C. to 175 degrees C., etc.).

Upon setting the timer value, and the battery system receiving the timer value (e.g., via the battery controller), the battery system may be enabled (block 106). While the battery system is enabled, the battery system may provide power to the release device system or to other systems to which the battery system is connected. While the battery system is providing power to associated systems, the battery system may provide enough power to be the sole source of power for the associated systems.

In certain circumstances, the operator may update (block 108) the timer value. For example, certain portions of an operation may take longer than expected. Accordingly, the operator may alter the timer value after the timer value has been set. This enables the operator to have greater flexibility in setting the timer value because the operator may quickly change the timer value, rather than cancelling the timer (e.g., by pulling the system back to the surface), and beginning a new timer. In some cases, the timer may be updated to an amount of time that would be expected to allow the ambient conditions of the wellbore 16 to raise the temperature of the battery system to some threshold temperature. This threshold temperature may be any suitable temperature that allows the battery system to operate sufficiently efficiently and/or effectively where damage to the battery system would be reduced and/or eliminated (e.g., 140 degrees C. to 190 degrees C., 150 degrees C. to 180 degrees C., 165 degrees C. to 178 degrees C., 170 degrees C. to 175 degrees C., etc.).

Once the timer expires, the battery system operates (block 110) the release device system. The timer may be utilized to ensure that the release device system will still be able to operate if communication and power to the surface is cut off. Accordingly, the expiring of the timer causes the battery controller to supply power to the release device system and cause the release device system to release the downhole tool from the toolstring. In some embodiments, the battery system may be connected to other systems, and the expiring of the timer may cause the battery system to provide power to and operation of another system.

Figure 5:
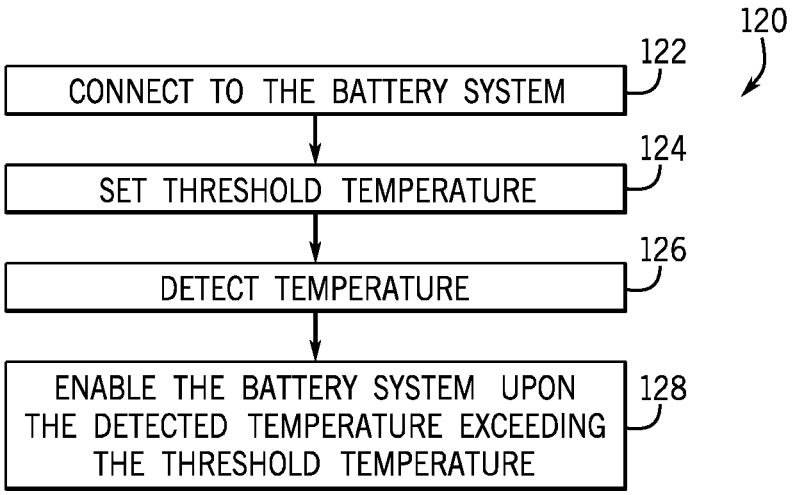
FIG. 5. is an embodiment of a process for operating the battery system of FIG. 2.

FIG. 5 is a flowchart of an embodiment of a process 120 for controlling the battery system to preserve the charge of the battery. The process 120 enables the battery system to operate under certain conditions automatically. Although the following process 120 includes a number of operations that may be performed, it should be noted that the process 120 may be performed in a variety of suitable orders (e.g., the order that the operations are discussed, or any other suitable order). All of the operations of the process 120 may not be performed. Further, all of the operations of the process 120 may be performed by the battery controller, the data processing system, an operator, or a combination thereof.

First, an operator may connect (block 122) to the battery system. For example, while the battery system is in the wellbore, the battery system may be in communication with the surface (e.g., via the cable). An operator may interact with the battery system via a user interface through which the operator may enter commands, view battery conditions (e.g., remaining charge, ambient temperature, etc.), etc.

In some cases, the operator may set (block 124) a threshold temperature for the operation of the battery system. For example, certain battery systems may operate more efficiently and/or effectively at certain temperature ranges (e.g., 140 degrees C. to 190 degrees C., 150 degrees C. to 180 degrees C., 165 degrees C. to 178 degrees C., 170 degrees C. to 175 degrees C., etc.). Thus, setting a threshold temperature may increase the time the battery system holds power. Note that, in some cases, a threshold temperature may not be set, but rather a timer may be set that represents an amount of time that would be expected to allow the ambient conditions of the wellbore 16 to raise the temperature of the battery system to some threshold temperature. This threshold temperature may be any suitable temperature that allows the battery system to operate sufficiently efficiently and/or effectively where damage to the battery system would be reduced and/or eliminated.

After setting a threshold temperature, and the battery system receiving the threshold temperature (e.g., via the battery controller), the battery system detects a temperature. As discussed above, the battery system may include sensors that may detect a temperature of the surroundings of the battery system, and the temperature data from the sensors may be sent to and received by the battery controller.

The battery controller may enable (block 128) the battery system upon the detected temperature exceeding the threshold temperature. For example, the battery system may be disabled at a lower temperature to increase the amount of time the power remains in the battery system, and to increase the lifespan of the battery system. Enabling the battery system after the threshold temperature has been exceeded may increase the efficiency of the battery system.

With the foregoing in mind, embodiments presented herein provide devices that are capable of extending the battery life and lifespan of a battery system. First, a battery system may receive a timer value, after which the battery system is enabled. The timer value may be updated before the expiration of the timer, which provides added flexibility to an operator. Upon the expiration of the timer, the battery system may operate a release device to release a downhole tool from a toolstring. Utilizing the timer may enable a battery system to operate the release device even in the absence of external power or communications. Further, a battery system may receive a threshold temperature. The battery system may receive temperature data of the conditions surrounding the battery system. Upon the detected temperature exceeding the temperature threshold value, the battery may begin operating. Doing so enables the battery system to operate more efficiently, and may increase the lifespan of the battery system.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The invention claimed is:

1. A method comprising:

receiving a timer value via a battery controller of a battery system;

enabling the battery system to provide power to a release device in a wellbore upon the battery controller receiving the timer value;

receiving an updated timer value via the battery controller, wherein the updated timer value changes the timer value, and the battery system continues to provide power to the release device at least until the updated timer value expires;

receiving a threshold temperature value via the battery controller;

receiving temperature data from one or more sensors via the battery controller; and enabling the battery system to provide power to the release device in the wellbore via the battery controller upon the temperature data exceeding the threshold temperature value;

disabling the battery system via the battery controller upon the temperature falling below a lower temperature threshold value and exceeding a higher temperature threshold value;

wherein the battery system further comprises a battery configured to operate at temperatures closer to a downhole environment temperature of the wellbore than a temperature at surface.

2. The method of claim 1, comprising operating, via the battery controller, the release device upon the timer value expiring or the updated timer value expiring.

3. The method of claim 2, wherein operating the release device comprises operating a motor of the release device to cause the release device to release a downhole tool in the wellbore.

4. The method of claim 2, wherein the battery system is the sole source of power for operating the release device.

5. The method of claim 1, comprising disabling the battery system via the battery if the temperature data is below the threshold temperature value.

6. The method of claim 1, comprising enabling the battery system to provide power to the release device in the wellbore via the battery controller upon receiving the timer value or upon the temperature data exceeding the threshold temperature value.

7. The method of claim 1, comprising enabling the battery system to provide power to the release device in the wellbore via the battery controller upon receiving the timer value and upon the temperature data exceeding the threshold temperature value.

8. A method comprising:

receiving a threshold temperature value via a battery controller of a battery system;

receiving temperature data from one or more sensors via the battery controller;

enabling the battery system to provide power to a release device in a wellbore upon the temperature data exceeding the threshold temperature value; and disabling the battery system via the battery controller upon the temperature falling below a lower temperature threshold value and exceeding a higher temperature threshold value;

wherein the battery system further comprises a battery configured to operate at temperatures closer to a downhole environment temperature of the wellbore than a temperature at surface.

9. The method of claim 8, comprising disabling, via the battery controller, the battery system if the temperature data is below the threshold temperature value.

10. The method of claim 8 comprising:

receiving a timer value via the battery controller;

enabling the battery system to provide power to the release device in the wellbore upon the battery controller receiving the timer value; and receiving an updated timer value via the battery controller, wherein the updated timer value changes the timer value, and the battery system continues to provide power to the release device at least until the updated timer value expires.

11. The method of claim 10, comprising operating, via the battery controller, the release device upon the timer value expiring or the updated timer value expiring.

12. The method of claim 11, wherein operating the release device comprises operating a motor of the release device to cause the release device to release a downhole tool in the wellbore.

13. The method of claim 11, wherein the battery system is the sole source of power for operating the release device.

14. The method of claim 10, comprising enabling, via the battery controller, the battery system to provide power to the release device in the wellbore upon receiving the timer value or upon the temperature data exceeding the threshold temperature value.

15. The method of claim 10, comprising enabling, via the battery controller, the battery system to provide power to the release device in the wellbore upon receiving the timer value and upon the temperature data exceeding the threshold temperature value.

16. A system comprising:

a battery system comprising:

a battery controller configured to:

receive a timer value;

enable the battery system to provide power to a release device in a wellbore upon receiving the timer value; and receive an updated timer value, wherein the updated timer value changes the timer value, and the battery system continues to provide power to the release device at least until the updated timer value expires; and a battery configured to operate at temperatures closer to a downhole environment temperature of the wellbore than a temperature at surface;

wherein the controller is configured to:

receive a threshold temperature value;

receive temperature data from one or more sensors;

enable the battery system to provide power to the release device in the wellbore upon the temperature data exceeding the threshold temperature value; and disable the battery system via the battery controller upon the temperature falling below a lower temperature threshold value and exceeding a higher temperature threshold value.

17. The system of claim 16, wherein the battery controller is configured to operate a motor of the release device to cause the release device to release a downhole tool in the wellbore upon the timer value expiring or the updated timer value expiring.

18. The system of claim 17, wherein the battery system is the sole source of power for operating the release device.

* * * * *